United States Patent [19]

Gendreau et al.

[11] Patent Number: 5,020,803

[45] Date of Patent: Jun. 4, 1991

[54] GOLF BALL AND METHOD OF MAKING SAME

[75] Inventors: Paul M. Gendreau, Swansea; Lauro C. Cadorniga, S. Dartmouth, both of Mass.

[73] Assignee: Acushnet Company, New Bedford, Mass.

[21] Appl. No.: 325,546

[22] Filed: Mar. 20, 1989

[51] Int. Cl.[5] ..... A63B 37/06; A63B 37/08; A63B 47/04; B29H 3/08

[52] U.S. Cl. ..... 273/225; 273/230; 264/248; 156/146; 156/170

[58] Field of Search ..... 273/222, 223, 224, 225, 273/226, 227, 228, 229, 214, 215, 216, 217; 264/248; 156/145, 146, 186, 169, 170

[56] References Cited

U.S. PATENT DOCUMENTS

| | | | |
|---|---|---|---|
| 1,198,366 | 9/1916 | Martin et al. | 273/224 X |
| 1,568,514 | 1/1926 | Lewis | 273/225 |
| 4,244,855 | 1/1981 | Cox et al. | 273/231 X |
| 4,505,334 | 3/1985 | Doner et al. | 156/170 X |
| 4,943,332 | 7/1990 | Sakaguchi et al. | 156/146 |

FOREIGN PATENT DOCUMENTS

| | | | |
|---|---|---|---|
| 137687 | 5/1948 | Australia . | |
| 147221 | 10/1951 | Australia . | |
| 237580 | 11/1960 | Australia . | |
| 273597 | 6/1964 | Australia . | |
| 38190 | 11/1969 | Australia . | |
| 695702 | 10/1964 | Canada | 273/226 |
| 1016783 | 1/1966 | United Kingdom | 273/227 |

*Primary Examiner*—George J. Marlo
*Attorney, Agent, or Firm*—Lucas & Just

[57] ABSTRACT

A golf ball with a low spin rate is made by covering the center with a layer of uncured rubber, curing the rubber layer to make a rubber shell about the core, and then winding elastic threads about the cured rubber shell to form a golf ball core. A golf ball cover is then applied to the core to form a golf ball.

The center is either a solid rubber sphere or a liquid-filled hollow envelope. The thickness of the rubber shell is between 0.16 cm and 0.64 cm.

34 Claims, 1 Drawing Sheet

GOLF BALL AND METHOD OF MAKING SAME

Figure 2:
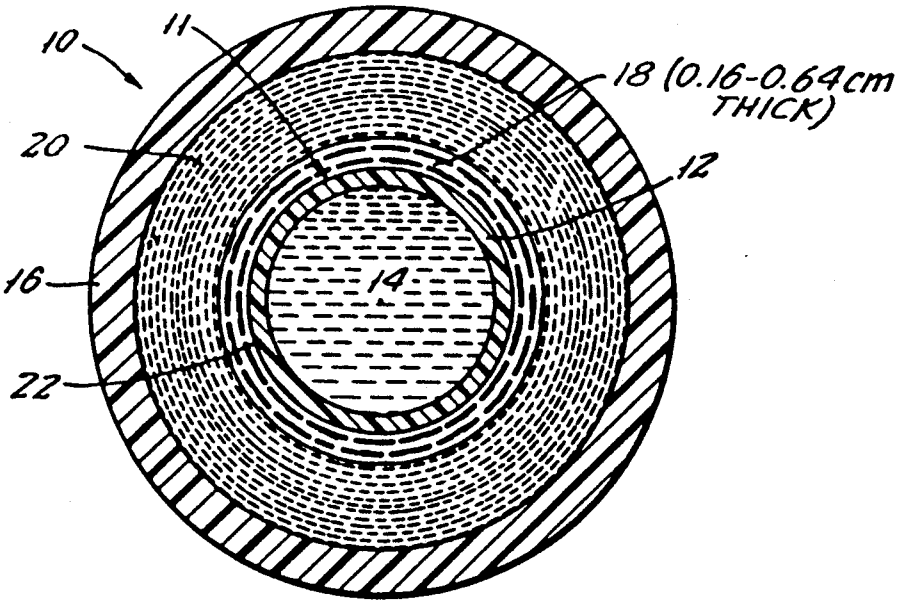

This invention relates to golf balls and, more particularly, to wound golf balls with liquid centers.

On the market today there are three main types of golf balls: one-piece, two-piece and wound. The one-piece ball is made of a homogeneous mass of thermoset or thermoplastic material, while the two-piece ball is made from a solid, homogeneous core around which a cover is molded. The wound, or three-piece, golf ball comprises a cover molded about a core that has been built up from a center around which elastic thread has been wound. The center of a wound ball is either a thin-walled, hollow sphere, commonly called an envelope, which is filled with a liquid or it is a solid homogeneous mass of a very resilient material such as polybutadiene or natural rubber. The liquid used to fill a liquid center is generally selected according to its specific gravity so that the overall weight of the ball is within the limit prescribed by the United States Golf Association, i.e. no greater than 1.62 ounces (45.93 gm). A typical liquid used is corn syrup, adjusted for specific gravity by the addition of an inert filler. The size of the center in wound balls typically varies from 1 inch (2.54 cm) to 1⅛ inch (2.86 cm), with a typical dimension being 1 1/16 inch (2.7 cm).

Balata covered three-piece golf balls have a higher spin rate than either Surlyn® covered three-piece balls or Surlyn® covered two-piece balls. Conventionally made two-piece golf balls having a Surlyn® cover typically have a spin rate of about 2200 rpm, while Surlyn® covered wound golf balls having a solid center typically have a spin rate of about 3000 rpm. Balata covered wound golf balls having a liquid center typically have a spin rate of about 3700 rpm.

It is known that lower spin rates result in a lower trajectory and a longer distance of travel for a given golf ball; however, many golfers prefer a balata cover over a Surlyn® cover because of the "click" and "feel" of the balata cover. "Click" is the sound made by the ball when it is hit by the club head, while "feel" is the overall sensation experienced by the golfer when the club head hits the ball. There is a need to reduce the rate of spin on a balata covered wound golf ball having a liquid center to make it comparable to the spin rate of the Surlyn® covered wound and two-piece golf balls.

The applicants have discovered a new wound liquid-center golf ball which has lower spin than that of the conventional wound liquid-center golf ball.

Broadly, the applicants have found that by surrounding a liquid-filled envelope with a hard cover prior to winding thread thereon, the wound golf ball so produced has a lower spin rate. More specifically, applicants have discovered a four-piece golf ball comprising a liquid-filled center; a hard, solid cover formed around said center; elastic thread wound around said hard cover; and an exterior dimpled cover formed over said elastic thread.

This invention also relates to an improved liquid-filled center for a three-piece golf ball, said improved center comprising a liquid-filled envelope around which a hard cover has been formed.

It has been found that forming a hard spherical cover around the liquid-filled center enables a larger liquid-filled center to be employed and requires the use of less thread while still having the same compression as compared to a conventional wound core having a liquid center.

Envelopes are made in a conventional manner by using two sheets of a rubber material and two mold plates. Each mold plate has a plurality of half molds therein and a vacuum tube connected to the apex of each half mold. Under heat the vacuum causes the rubber sheet to take on the half mold shape. Water is sprayed across the bottom mold and the two mold plates are joined. The respective half molds also join to form a complete rubber envelope. This rubber envelope is subsequently subjected to additional heat to expand the envelope to a fully inflated hollow sphere. The envelope is then filled with a liquid in a conventional manner, usually by a hypodermic needle, and, finally, the hole left by the hypodermic needle is sealed.

In accordance with the present invention, a heavy-walled sphere is formed around the liquid-filled envelope. Suitable means for forming the heavy-walled sphere around the liquid-filled envelope include wrapping pieces of uncured rubber around the envelope and then curing those pieces of uncured rubber around the envelope to form a heavy-walled sphere around the envelope. The pieces can be two half-shells which are preformed and subsequently joined around the liquid-filled half-shell. Good results have been obtained by merely cutting flat, rectangular pieces from a sheet of uncured rubber, wrapping the rectangular pieces of uncured rubber around the envelope, placing the wrapped center into a mold and subjecting the wrapped center to a temperature and pressure such that the rubber cures and forms a homogeneous, solid walled sphere around the liquid-filled envelope. Preferably, these strips measure about 1/16 inch (0.16 cm) thick, about ½ inch (1.3 cm) wide and about 1 feet (0.3 m) long. These strips are manually wrapped around a center to a uniform thickness. The mold used to cure the rubber is of sufficient size to hold the fully wrapped center.

Because the wrapped envelope is subjected to heat and pressure to cure the rubber, it has been found that the liquid used to fill the center must have a sufficiently high boiling point to withstand boiling during the curing process of the wrap. Preferably, the liquid should have a boiling point of about 20°-30° C. above the cure temperature of the material used to wrap the center. When using 1'×½"×1/16" (0.3 m×1.3 cm×0.16 cm) strips of uncured hard rubber compound, to wrap the center to a thickness of about 3/32 inch (0.24 cm), glycerine, 1,2,3-propanetriol, which has a boiling point of about 290° C. has been found to yield good results.

Suitable materials for making the heavy-walled sphere are thermoset hard rubber compounds, thermoplastic plastic materials and castable urethane thermoset materials. Most preferred are thermoset hard rubber compounds such as natural rubber, polybutadiene or a mixture thereof.

The solid walled sphere has a thickness of about 1/16 inch (0.16 cm) to about ¼ inch (0.64 cm). Good results have been obtained with a wall thickness of about 3/32 inch (0.24 cm).

The heavy-walled, solid sphere is hard. Preferably, it has a hardness in the range of about 80 to about 95, and most preferably about 90 to about 95. Good results have been found with a hardness of about 90 when measured with a type-C Durometer hardness tester per ASTM No. D2240-75.

The core having a hard wall surrounding the liquid-filled envelope has a diameter measuring between about 1 inch (2.54 cm) to about 1½ inch (3.81 cm). Preferably, the hard-walled core measures about 1.0 inch (2.54 cm) to about 1⅜ inch (3.5 cm) in diameter. Good results have been obtained with a hard-walled core measuring 1¼ inch (3.175 cm).

On top of this heavy walled, solid sphere, elastic thread is wound in a conventional manner.

Figure 1:
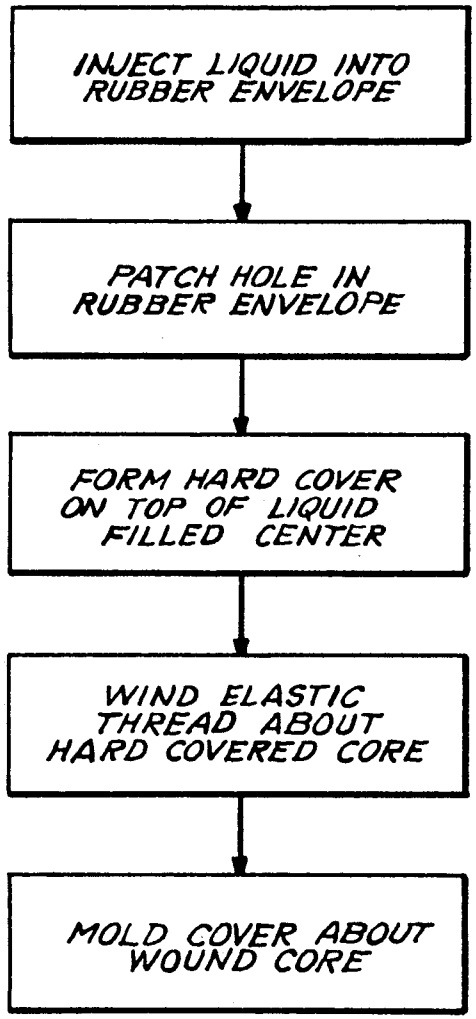

These and other aspects of the present invention may be more fully understood with reference to the accompanying drawings wherein:

FIG. 1 illustrates a flow diagram for the method of the present invention; and FIG. 2 illustrates a golf ball made in accordance with the present invention.

Referring to FIG. 2, there is shown golf ball 10 having liquid center 11. The liquid center comprises rubber envelope 12 with liquid 14 therein. Golf ball cover 16 is about the exterior of the ball. The cover 16 is of conventional construction such as balata, gutta percha, Surlyn®, polyurethane or a combination of the foregoing. Liquid-filled center 11 is surrounded by a hard cover 18. Between golf ball cover 16 and hard center cover 18 is elastic thread 20. The interface between envelope 12 and hard center cover 18 is shown by reference numeral 22. There is no space between hard center cover 18 and envelope 12.

These and other aspects of the present invention may be more fully understood with reference to the following examples.

EXAMPLE 1

This example illustrates making a wound core of the present invention. As shown in FIG. 1, glycerine was injected into the envelope and the envelope was patched with an adhesive material. Next, strips measuring 1'×½"×1/16"(0.3 m×1.3 cm×0.16 cm) were cut from a sheet of uncured hard rubber compound. The sheet was formed in a conventional mixing of the components and then sheeted off and hand cut. The strips were manually wrapped around the liquid-filled center and then the wrapped center was placed into a smooth-walled ball mold which was subsequently closed and subjected to heat and pressure, about 320° F. for about 4 minutes, in order to cure the hard rubber compound. The hard covered center was then demolded.

EXAMPLE 2

This example illustrates the reduced spin obtained with a golf ball having a liquid-filled, hard cover center of the present invention as compared to a hard center wound golf ball and a two-piece golf ball. Table I below illustrates the results:

TABLE I

| Property | DT Control | Pinnacle Control | Present Invention |
|---|---|---|---|
| Ball diameter, inches (cm) | 1.68 (4.3) | 1.68 (4.3) | 1.68 (4.3) |
| PGA compression | 66 | 66 | 66 |
| Spin rate (rpm) | 3094 | 2309 | 2274 |

The golf ball of the present invention had a glycerine-filled envelope measuring 1 1/16 inch (2.7 cm) and a cover of hard rubber compound around the envelope having a thickness of 3/16 inch (0.5 cm).

The DT is a commercial three-piece ball having a solid rubber center sold by Acushnet Company and the Pinnacle is a commercial two-piece ball sold by Acushnet Company. All three balls had covers made of Surlyn®.

Spin rate was determined by photographing the ball in flight at two points. For purposes of this example, each ball was hit using a dual pendulum machine having a 15° face. The face was traveling at 454 RPM (138 m/min.). The angle was measured from a vertical axis. Strobe lights and a single camera were used to get a double exposure of the ball on a single frame of film at two different points in the ball's line of travel. A yardstick was positioned just below tee ball's flight path such that the yardstick appeared in the double-exposed photograph.

PGA compression was determined using a commercial PGA compression tester. The measurements were performed in a conventional manner well-known to those of skill in the art of golf ball manufacturing.

It will be understood that each and every numerical value which appears in the claims herein is modified by the term "about" if the modifying term "about" does not appear in front of such numerical value.

It will be understood that the claims are intended to cover all changes and modifications of the preferred embodiments of the invention herein chosen for the purpose of illustration which do not constitute a departure from the spirit and scope of the invention.

What is claimed is:

1. A method of making a golf ball comprising the steps of:

(a) applying a layer of uncured rubber around a liquid-filled golf ball center;

(b) curing said rubber to form a rubber shell about said center;

(c) winding elastic thread about said rubber shell to form a wound core; and (d) placing a golf ball cover about said wound core to form a golf ball.

2. The method of claim 1 wherein said rubber is cured by applying heat to said uncured rubber.

3. The method of claim 1 wherein said rubber shell has a thickness of between about 0.16 cm and about 0.64 cm.

4. The method of claim 1 wherein said rubber shell has a hardness of about 80 to about 95 as measured by a Shore C Durometer.

5. The method of claim 1 wherein the liquid in said liquid-filled golf ball center has a boiling point of about 20° to about 30° C. above the cure temperature of said rubber.

6. The method of claim 1 wherein the liquid in said liquid-filled golf ball center is glycerine.

7. A golf ball made in accordance with the method of claim 1.

8. A method of making a golf ball comprising the steps of:

(a) filling a hollow spherical envelope with a liquid to form a liquid-filled center;

(b) applying a layer of uncured rubber around said center;

(c) curing said rubber to form a rubber shell about said center;

(d) winding elastic thread about said rubber shell to form a wound core; and (e) placing a golf ball cover about said wound core to form a golf ball.

9. The method of claim 8 wherein the liquid in said liquid-filled center has a boiling point of about 20° to about 30° C. above the cure temperature of said rubber.

10. The method of claim 8 wherein the liquid in said liquid-filled center is glycerine.

11. The method of claim 8 wherein said rubber is cured by applying heat to said uncured rubber.

12. The method of claim 8 wherein said rubber shell has a thickness of between about 0.16 cm and about 0.64 cm.

13. The method of claim 8 wherein said rubber shell has a hardness of about 80 to about 95 as measured by a Shore C Durometer.

14. A golf ball made in accordance with the method of claim 8.

15. A method for making a center for a thread wound golf ball comprising the steps of:

(a) filling a hollow spherical envelope with a liquid to form a filled envelope;

(b) applying a layer of uncured rubber around said filled envelope; and (c) curing said rubber to form a rubber shell about said filled envelope to form a center for a thread wound golf ball.

16. The method of claim 15 wherein said liquid has a boiling point of about 20° to about 30° C. above the cure temperature of said rubber.

17. The method of claim 15 wherein said liquid is glycerine.

18. The method of claim 15 wherein said rubber is cured by applying heat to said uncured rubber.

19. The method of claim 15 wherein said rubber shell has a thickness of between about 0.16 cm and about 0.64 cm.

20. The method of claim 15 wherein said rubber shell has a hardness of about 80 to about 95 as measured by a Shore C Durometer.

21. A golf ball center made in accordance with the method of claim 15.

22. A golf ball made using said golf ball center of claim 21.

23. A golf ball comprising:

(a) a liquid-filled center;

(b) a rubber shell formed around said center, said rubber shell having a thickness between 1/16 inch and ¼ inch, said rubber shell having the structural characteristics of cured rubber which was formed by curing a layer of uncured rubber about said center;

(c) elastic thread wound around said rubber shell; and (d) a dimpled cover formed over said elastic thread.

24. The golf ball of claim 23 wherein the liquid in said center has a boiling point of 20° to 30° C. above the cure temperature of said rubber.

25. The golf ball of claim 23 wherein the liquid in said center is glycerine.

26. The golf ball of claim 23 wherein said rubber shell has a hardness of 80 to 95 as measured by a Shore D Durometer.

27. The golf ball of claim 23 wherein said rubber shell comprises natural rubber.

28. The golf ball of claim 23 wherein said rubber shell comprises a mixture of natural rubber and polybutadiene.

29. An improved golf ball having reduced spin, said golf ball comprising a liquid-filled center for a thread wound golf ball, elastic thread wound around said center and a cover formed around said elastic wound center, the improvement comprising:

a rubber shell formed about said liquid-filled center and being located between said center and said elastic thread, said rubber shell having a thickness between 1/16 inch and ¼ inch, said rubber shell having the structural characteristics of cured rubber which was formed by curing a layer of uncured rubber about said center.

30. The golf ball of claim 29 wherein the liquid in said center has a boiling point of 20° to 30° C. above the cure temperature of said rubber.

31. The golf ball of claim 29 wherein the liquid in said center is glycerine.

32. The golf ball of claim 29 wherein said rubber shell has a hardness of 80 to 95 as measured by a Shore D Durometer.

33. The golf ball of claim 29 wherein said rubber shell comprises natural rubber.

34. The golf ball of claim 29 wherein said rubber shell comprises a mixture of natural rubber and polybutadiene.

* * * * *